US007156227B2

(12) United States Patent
De Laforcade

(10) Patent No.: US 7,156,227 B2
(45) Date of Patent: Jan. 2, 2007

(54) SYSTEM AND METHOD FOR MIXING AT LEAST TWO PRODUCTS

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/035,204

(22) Filed: Jan. 4, 2002

(65) Prior Publication Data

US 2002/0104766 A1 Aug. 8, 2002

(30) Foreign Application Priority Data

Jan. 4, 2001 (FR) ..... 01 00086

(51) Int. Cl.
*B65D 25/08* (2006.01)

(52) U.S. Cl. ..... 206/219; 206/222; 215/DIG. 8

(58) Field of Classification Search ..... 206/219–222, 206/568; 215/DIG. 8
See application file for complete search history.

(56) References Cited

U.S. PATENT DOCUMENTS

| | | | | |
|---|---|---|---|---|
| 3,941,270 A | | 3/1976 | Spielman | |
| 4,917,237 A | * | 4/1990 | Groves et al. | 206/219 |
| 4,971,193 A | * | 11/1990 | Groves et al. | 206/219 |
| 5,027,872 A | * | 7/1991 | Taylor et al. | 206/219 |
| 5,209,565 A | | 5/1993 | Goncalves | |
| 5,277,303 A | * | 1/1994 | Goyet et al. | 206/221 |
| 5,908,107 A | * | 6/1999 | Baudin | 206/221 |
| 6,068,396 A | * | 5/2000 | Baudin | 206/219 |
| 2002/0020637 A1 | * | 2/2002 | De Laforcade | 206/219 |

FOREIGN PATENT DOCUMENTS

| | | |
|---|---|---|
| FR | 2 685 301 | 6/1993 |
| JP | T H6-505465 | 6/1994 |

OTHER PUBLICATIONS

Patent Abstracts of Japan, vol. 1999, No. 03, Mar. 31, 1999 (JP 10 316176).

* cited by examiner

*Primary Examiner*—Mickey Yu
*Assistant Examiner*—J. Gregory Pickett
(74) *Attorney, Agent, or Firm*—Finnegan, Henderson, Farabow, Garrett & Dunner, LLP

(57) ABSTRACT

The present application relates to a system and method for mixing at least two products that includes a first container for containing at least a first product, the first container including a first opening, a first coupler, and a safety member. The system may further include a second container for containing at least a second product, the second container including a second opening, a seal closing the second opening, and a second coupler configured to engage with the first coupler. The safety member may be configured to press against the seal while the seal maintains closure of the second opening.

61 Claims, 3 Drawing Sheets

SYSTEM AND METHOD FOR MIXING AT LEAST TWO PRODUCTS

Figure 1:
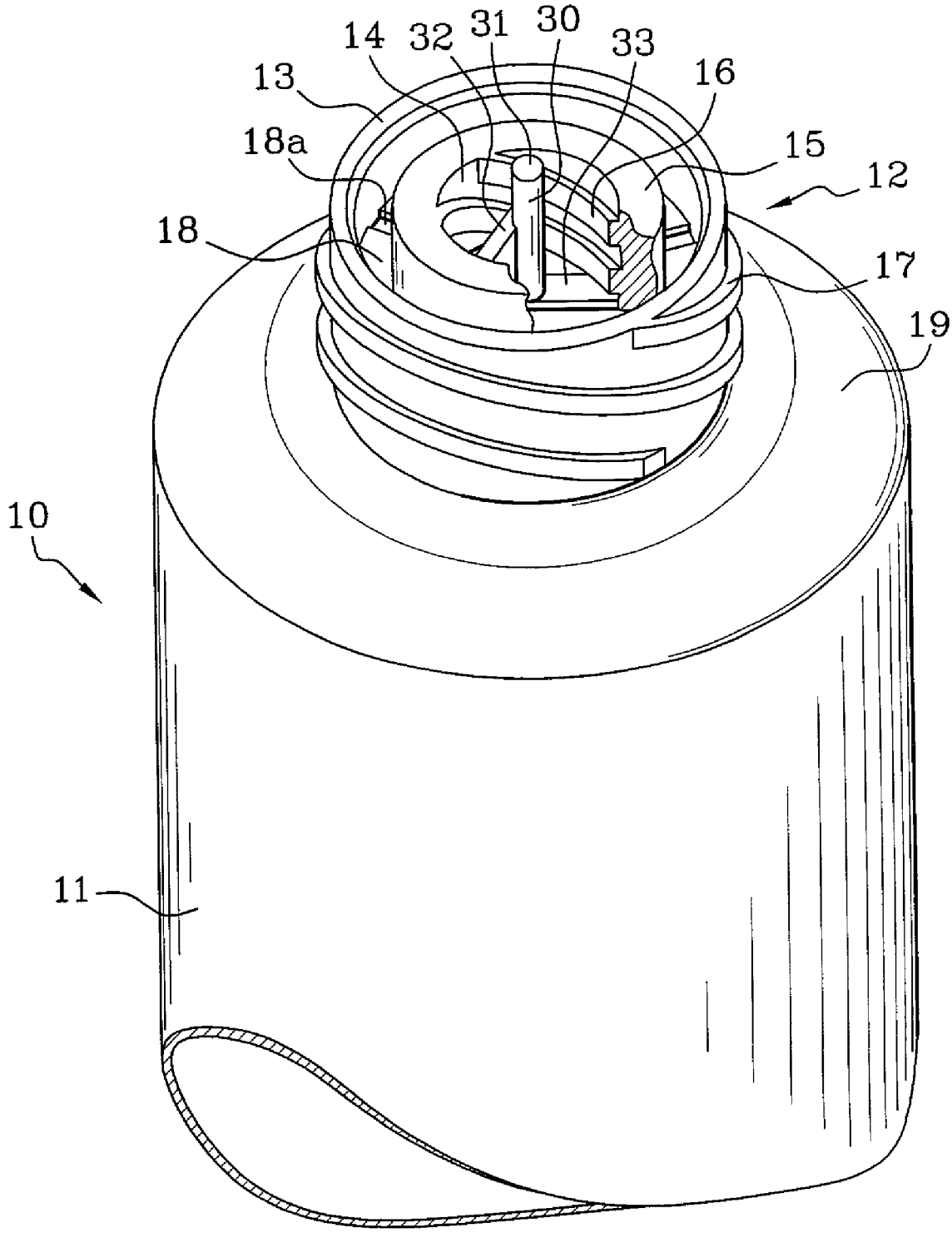

The present invention relates to a system and method for packaging and mixing at least two products, the at least two products being optionally intended to form a composition, for example, a cosmetic composition that may be optionally used for dyeing hair.

In the field of home hair dyeing, hair dyeing products often have multiple components packaged in two different containers. For example, an oxidation dyeing product may include an oxidizing cream and a dye cream, each of which is packaged in a separate container, because the oxidizing cream and the dye cream should not be mixed until the time of application of the mixture to the hair.

Various types of containers have been used for packaging hair dyeing products, such as oxidation dyeing products. The dye cream, for example, may be generally contained in an aluminum tube sealed by a film seal formed by a fine film of aluminum. The tube may be closed by a cap, which may have a spike on its exterior top wall. The spike may be designed to perforate the film seal. Such a tube may be generally formed from a skirt closed at its lower part by a rolled fold, for example. A container of the "squeezy bottle" type may be used for packaging the oxidizing cream. Alternately, the squeezy bottle may be replaced by a tube with more flexible walls, into which the dye may be introduced at the time of application of the dye composition. To bring the products into contact with one another, it may be necessary to first open the aluminum tube and perforate the film using the spike by inverting the stopper. The two tubes may have coupling devices that allow connection of the tubes by fixing them together so as to bring the two products into contact with one another.

In some instances, users may forget to perforate the aluminum film seal before coupling the two tubes together via the coupling devices provided on each of the tubes. As a result, various systems for mixing such products, including systems in which the container containing the dye cream is fitted with a perforating device, have been proposed.

Patent application FR 2 685 301 describes, for example, a unit including a tube that optionally contains a dye cream and a pot that optionally contains an oxidizing cream. The tube may be provided with a threaded neck, the opening of which may be closed by a tear-off film seal. The pot may be closed by a cap formed from a plate that bears a skirt, the interior wall of which may be threaded. An opening may be formed at the center of the plate inside the threaded skirt. The opening may be bordered by a cutting ring. To perform mixing, the neck of the tube may be threaded into the skirt of the pot, and the ring may then tear the film seal so as to place the tube and the pot in communication with each other. However, the torn seal may remain in the tube and may impede passage of product. In addition, a user may fail to thread the neck of the tube far enough into the skirt of the pot for the ring to tear the seal. The user, believing that the seal is perforated, may then press the tube containing the dye cream, with the cream being unable to exit the tube through the opening closed by the seal. For example, when a tube is formed from aluminum and has a skirt, the lower part of which may be closed via a rolled fold, the resulting pressure exerted by the user may be relatively great, and may cause the end of the tube to unroll. As a result, the cream may escape through the end of the tube and spray onto the user.

An optional object of the invention is to provide a system for packaging and mixing at least two products intended to form a cosmetic composition. Optionally, the system may address one or more disadvantages of the prior art.

Another optional object of the invention is to provide a system for packaging and mixing products that is very safe.

Yet another optional object of the invention is to provide a system for packaging and mixing products that is economical to produce, and that is simple and reliable to use.

In accordance with the purpose of the invention, as embodied and broadly described herein, the invention includes a system for mixing at least two products. The system may include a first container for containing at least a first product. The first container may include a first opening, a first coupler, and a safety member. The system may further include a second container for containing at least a second product. The second container may include a second opening, a seal closing the second opening, and a second coupler configured to engage with the first coupler. The safety member may be configured to press against the seal while the seal maintains closure of the second opening.

As used herein, the term "engage" means to mesh or interlock.

According to another optional aspect of the invention, a system for mixing at least two products may include a first container for containing a first product. The first container may include a first opening, a first coupler, and a safety member. The system may further include a second container for containing a second product. The second container may include a second opening, a displaceable seal closing the second opening, and a second coupler configured to engage with the first coupler. The safety member may be configured to prevent engagement between the first coupler and the second coupler prior to displacement of the seal.

Thus, when the user forgets to remove the seal, for example, the safety member may press against the seal and indicate to the user that the two containers should not be engaged prior to removing or displacing the seal, for example, by peeling, so as to substantially uncover the orifice, or optionally, that the seal may need to be perforated.

Yet another optional aspect of the invention may include a system wherein the seal includes a film seal.

An additional optional aspect of the invention may include a system wherein the safety member is configured to press against the seal while the first and the second couplers are out of engagement with one another.

Another optional aspect of the invention may include a system wherein the safety member includes a protrusion extending at least partially beyond the first opening. The protrusion may comprise, for example, a blunt end for pressing against the seal. The second container may be inhibited by the safety member prior to engaging the first container. As a result, it may be very difficult for the two containers to engage each other.

An additional optional aspect of the invention may include a system wherein the blunt end comprises a flat surface.

The blunt end may result in a stop that may not easily displace the seal when a user attempts to engage the second container with the first container without exerting undue force.

Yet another optional aspect of the invention may include a system wherein the first container further comprises an opening element for displacing portions of the seal from the second opening when the first coupler engages with the second coupler such that the second opening becomes at least partially uncovered to enable the first container to be in flow communication with the second container for mixing the first and second products.

The opening element may provide a second level of safety. For example, if a user attempts to insert the second container into the first container without having removed or displaced the seal and pushes the seal with a relatively significant amount of force, the opening element may remove the seal correctly and allow the product to flow appropriately. The opening element, for example, may completely remove the seal by weakening the region of attachment of the film seal to the second container.

An additional optional aspect of the invention may include a system wherein the opening element comprises a cutting device for at least partially cutting the seal when the first coupler engages with the second coupler. For example, the cutting device may comprise a trocar.

Yet another optional aspect of the invention may include a system wherein the safety device comprises an end surface configured to contact the seal. The cutting device may be formed by a portion of the safety member spaced from the end surface.

The cutting device may be used in exceptional circumstances, for example, when the user has pushed the safety member through the seal.

In an optional aspect, first coupler may comprise a first screw threading, and the second coupler may comprise a second screw threading for engaging the first screw threading, such that the two containers may be substantially secured together and the two products can come into contact with each other.

Alternatively, other types of couplers providing substantially sealed communication between the first and second containers may be provided, including, but not limited to, snap-fastening devices, bayonet devices, and sliding mounting devices.

Yet another optional aspect of the invention may include a system wherein the first container further comprises a neck and a hollow shaft located within the neck. The hollow shaft may define the first opening and the first coupler may be located on the hollow shaft. Optionally, the safety member may extend within the hollow shaft. The hollow shaft may be connected to the neck via a connecting element and the connecting element may comprise at least one vent orifice for allowing air to escape during mixing of the first and second products. Optionally, the hollow shaft and the neck may form a head. The head may be formed of a single piece of material, such as by injection molding. Forming the head by optional injection molding may result in a container which is simple and inexpensive to produce. Alternatively, the head may be formed of multiple pieces.

In another aspect, the first container may comprise a body, and the head may be mounted on the body by one of welding and bonding.

According to another optional aspect of the invention, the system may also include a removable stopper for closing the first opening and/or for protecting the safety member. The removable stopper may comprise a frangible end such that the removable stopper may be used as an applicator tip. Optionally, the first container may comprise a neck bearing a screw thread for securing the removable stopper to the first container.

According to another optional aspect, the removable stopper may be configured to be secured to the second container via the second coupler in both a first position and a second position. The seal may be capable of being protected in the first position and the seal may be capable of being displaced in the second position.

In yet another optional aspect, the removable stopper may comprise a wall having skirt including a screw threading for engaging the second coupler, and the removable stopper may further comprise a perforating member.

In an additional optional aspect, the first container may comprise a tube. The tube may have elastically deformable walls. The tube may be formed from, for example, polyethylene.

Optionally, the second container may comprise a tube such as a tube formed from aluminum, and the seal may comprise an aluminum film.

According to another optional aspect of the invention, the system may comprise a first product contained in the first container and a second product contained in the second container. The first product and the second product comprise a composition that when mixed, is one of a cosmetic product and a care product. For example, the composition may comprise one of a hair coloring product and a hair care product.

An additional optional aspect of the invention may include a system wherein the first product comprises an oxidizing agent and the second product comprises a dye.

According to another optional aspect of the invention, a method of mixing at least two products may include providing a system for mixing at least two products, wherein a first product is contained in the first container and a second product is contained in the second container. The method may also comprise engaging the first coupler with the second coupler and mixing the first product and the second product. The mixing of the first product and the second product may form a composition, such as one of a cosmetic product and a care product. For example, the composition may comprise one of a hair coloring and a hair care product. When the product is a hair composition, the first product may comprise an oxidizing agent and the second product may comprise a dye.

The term "providing," and forms thereof, is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

Optionally, the method may also include displacing the seal prior to engaging the first coupler with the second coupler.

In yet another optional aspect, the system may further comprise a removable stopper configured to be secured to the second container via the second coupler, and the displacing of the seal may comprise displacing the seal via the removable stopper.

The systems that have been described may be particularly useful for preparing a cosmetic composition, for example, a hair composition, with the first product being an oxidizing agent and the second product being a dye.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1 is a schematic perspective view of an optional embodiment of a first container of a system for mixing at least two products;

FIGS. 2A–2H are views of various stages of operation of an optional embodiment of a system for mixing at least two products in a first mode of use; and FIGS. 3A–3D are views of various stages of operation of the optional embodiment of a system for mixing at least two products in a second mode of use.

Reference will now be made in detail to optional embodiments of the invention, examples of which are illustrated in the accompanying drawings. Wherever possible, the same reference numbers are used in the drawings and the description to refer to the same or like parts.

Figures 2A, 2B, 2C, 2D, 2E, 2F, 2G, 2H:
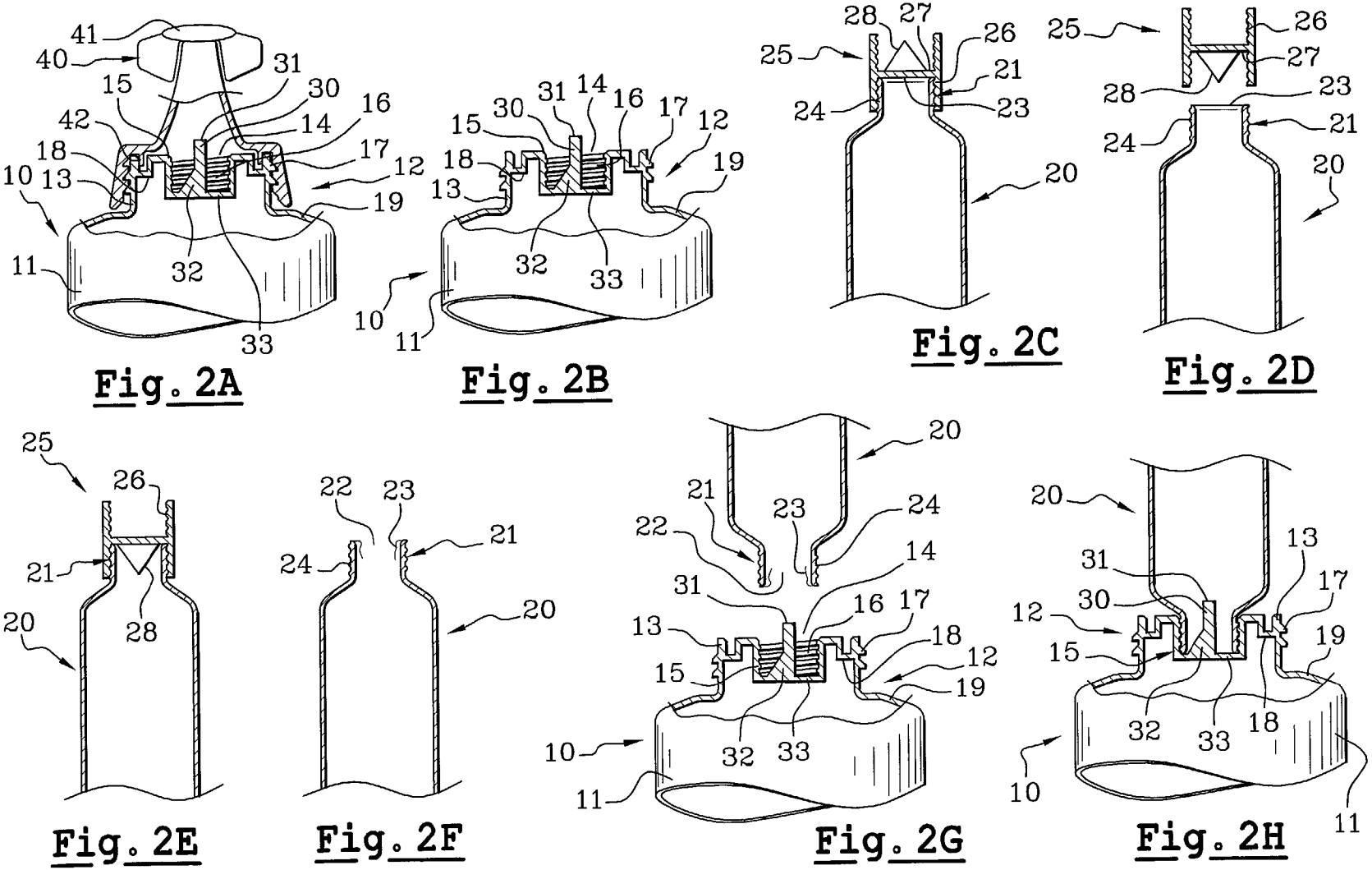

As shown in FIGS. 1 and 2A–2B, the system may comprise a first container 10 containing a first product. The first product may be, for example, an oxidizing agent. The system may also comprise a second container 20, as shown in FIGS. 2C through 2F, containing a second product. The second product may be, for example, an oxidation dye. The two products mixed together may be intended to form a composition, such as a cosmetic product or a care product, for example, a hair coloring product or a hair care product.

The first container 10 may be a polyethylene tube, for example. The first container 10 may comprise a body 11 on which a head 12 may be mounted. The head 12 may include a shoulder 19 that connects the body 11 to a neck 13, which may be provided with a thread 17 on an exterior wall. A hollow axial shaft 15, coaxial with the neck 13, for example, may be mounted inside the neck 13. An annular disc 18 including vent orifices 18*a* may be provided, and may connect the hollow axial shaft 15 to the neck 13. Together with the neck 13 and the hollow axial shaft 15, the annular disk 18 may define a sealing spout that may substantially seal the first container 10. The hollow axial shaft 15 may define an opening 14 of the first container 10 that may allow passage of a product. The interior wall of the hollow axial shaft 15 may have a screw thread 16 that may allow a second container 20 to be secured to the first container 10. A protrusion 30, which may be flat at its end 31, protruding from the opening 14 of the first container 10, may be mounted fixedly inside the hollow axial shaft 15. The protrusion 30 may be supported by a bar 33, each end of which may be fixed to the interior wall of the hollow axial shaft 15. The bar 33 may pass across a passage formed by the hollow axial shaft 15. An opening element 32, such as a triangular cutter or a trocar, may be formed in the base of the protrusion 30. The protrusion 30, the bar 33, and the hollow axial shaft 15 may optionally be formed as a single piece, for example, by injection molding.

The first container 10 may be closed by a removable stopper 40, as shown in FIG. 2A. Part of the interior wall of the removable stopper 40 may have a screw thread that complements the screw thread 17 of the neck 13 so that the removable stopper 40 may be secured to the first container 10. The removable stopper 40 may allow the opening 14 of the first container 10 to be closed. The removable stopper 40 may also protect the protrusion 30. An annular wall 42 may be optionally provided inside the removable stopper 40 and may become lodged in the sealing spout formed between the neck 13 and the hollow axial shaft 15 when the removable stopper 40 is threaded onto the first container 10. The removable stopper 40 may be advantageously provided with a snap-off end 41 which may be broken off in response to a twisting movement about the axis of the first container 10, for example. When the snap-off end 41 is removed, an orifice may be opened through which the composition may pass once the two products have been mixed. The removable stopper 40 may have an appropriate shape so that it may be used as an applicator tip, for example, such that the mixed composition may be easily applied to hair, for example.

The second container 20, as shown in FIGS. 2C through 2F, may also be in the form of a tube. The second container 20 may be formed from aluminum, with a body having a neck 21 at one end and another end that may be closed, for example, by rolling. The neck 21 may define an opening 22 that may be closed by a film seal 23, for example. The film seal 23 may be a fine film of aluminum formed directly, for example, when the second container 20 is a tube manufactured of aluminum. The neck 21 may include a screw thread 24 on an exterior wall, whereby the screw thread 24 may be threaded into the hollow axial shaft 15 of the first container 10, by virtue of the complementary screw thread 16 provided on an interior wall of the hollow axial shaft 15. The second container 20 may be closed by a cylindrical stopper 25 formed by a wall 27 and by a first skirt equipped with a screw thread 26 that may complement the screw thread 24 of the neck 21 of the second container 20. A spike 28 may be provided on the wall 27, opposite the threaded skirt, for perforating the seal 23, formed, for example, from an aluminum film. To protect the spike 28, the spike 28 may be surrounded by a second skirt that, for example, continues the first skirt that constitutes the cylindrical stopper 25.

The system that has been described may be used as follows and as shown in FIGS. 2A through 2H. The user may first have a first container 10 containing an oxidizing cream, for example. The first container 10 may be closed by a removable stopper 40, as shown in FIG. 2A. The user may remove the removable stopper 40, uncovering the opening 14 of the first container 10, as shown in FIG. 2B. The user may also have a second container 20 containing, for example, a dye cream. The second container 20 may be closed via its stopper 25, as shown in FIG. 2C. The user may then unscrew the stopper 25 with the seal 23 maintaining closure of the second container 20, as shown in FIG. 2D. The stopper 25 may then be inverted and engaged with the neck 21 of the second container 20. The spike 28 may be inserted into the neck 21 and pierce the seal 23, as shown in FIG. 2E. The opening 22 of the second container 20 may now be uncovered, as shown in FIG. 2F. The user may engage the neck 21 of the second container 20 with the hollow axial shaft 15 of the first container 10, as shown in FIGS. 2G and 2H. The user may empty the second container 20 by pressing its walls and transferring substantially all of the dye cream, for example, into the first container 10 containing the oxidizing cream, for example. The user may thread the removable stopper 40 back onto the first container 10 and shake the first container 10, thereby substantially homogenizing the mixture. The user may also break off the snap-off end 41 of the removable stopper 40 and apply the composition, for example, in a conventional manner.

Figure 3A:
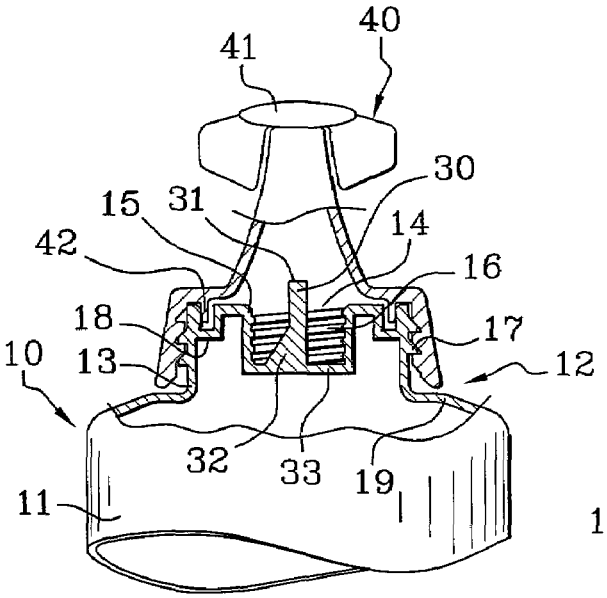
Figure 3B:
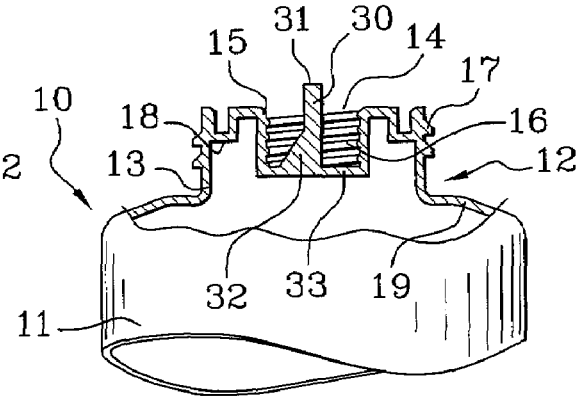
Figure 3C:
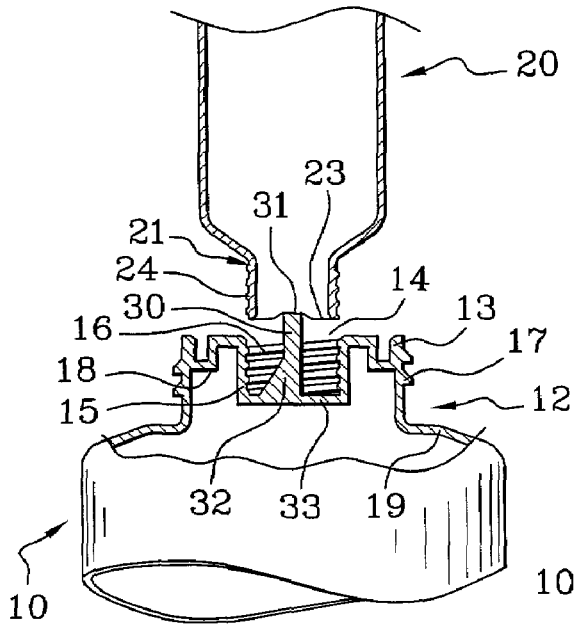

When the seal 23 has not been perforated prior to engaging the two containers, the system according to optional aspects of the invention may be used in the manner shown in FIGS. 3A through 3D. The user may have a first container 10 containing, for example, an oxidizing cream. The first container 10 may be closed by the removable stopper 40, which the user may remove in order to uncover the opening 14 of the first container 10, as shown in FIGS. 3A and 3B. The second container 20, closed by the seal 23, may then be positioned adjacent the first container 10, as shown in FIG. 3C. The seal 23 may abut against the end 31 of the protrusion 30, which may protrude from the opening 14 of the first container 10, thereby preventing the neck 21 of the second container 20 from being able to engage the hollow axial shaft 15 of the first container 10. The user, feeling resistance, may stop attempting to engage the containers 10 and 20, and remove the seal 23, optionally using the spike 28 provided on the stopper 25 of the second container 20. After removing or piercing the seal 23, the user may engage the neck 21 of the second container 20 with the hollow axial shaft 15 of the first container 10, as shown in FIGS. 2G and 2H.

Figure 3D:
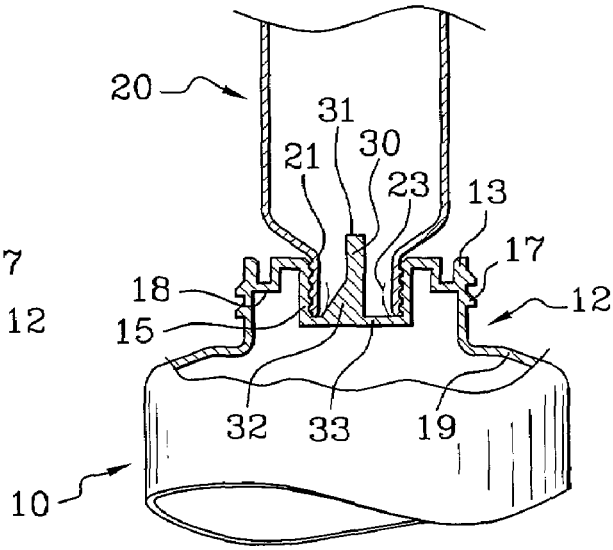

Alternatively, if the user continues to attempt to engage the two containers 10 and 20 without removing the seal 23, the user may optionally drive the neck 21 of the second container 20 into the hollow axial shaft 15 of the first container 10 with sufficient force that the protrusion 30 tears the seal 23. It may then be possible to engage the neck 21 with the hollow axial shaft 15. During engagement, the opening element 32, for example, a triangular cutter or a trocar, may cut the seal 23 so as to substantially uncover the opening 22 of the second container 20, as shown in FIG. 3D. The user may empty the dye cream, for example, into the first container 10, mix, and apply the dye composition obtained, for example, to hair.

The containers according to the optional aspects of the invention may contain any make-up or care products, such as cosmetic, dermatological, or pharmaceutical compositions used for treating hair, skin, lips, or nails. However, in its broadest aspects, the present invention could be used to contain many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A system for mixing at least two products, the system comprising:

a first container for containing at least a first product, the first container comprising
- a first opening,
- a first coupler,
- a neck,
- a hollow shaft located within the neck, and
- a blunt safety member;

a second container for containing at least a second product, the second container comprising
- a second opening,
- a seal closing the second opening, and
- a second coupler configured to engage with the first coupler; and a perforating member configured to pierce the seal closing the second opening, wherein the safety member is configured to press against the seal while the seal maintains closure of the second opening, wherein the first opening is not completely obstructed by the safety member, wherein the safety member extends through the first opening, wherein the hollow shaft defines the first opening and the first coupler is located on the hollow shaft, and wherein the hollow shaft is connected to the neck via a connecting element and the connecting element comprises at least one vent orifice for allowing air to escape during mixing of the first and second products.

2. The system of claim 1, wherein the seal comprises a film seal.

3. The system of claim 1, wherein the safety member is configured to press against the seal while the first and the second couplers are out of engagement with one another.

4. The system of claim 1, wherein the safety member comprises a protrusion extending at least partially beyond the first opening.

5. The system of claim 4, wherein the protrusion comprises a blunt end for pressing against the seal.

6. The system of claim 5, wherein the blunt end comprises a flat surface.

7. The system of claim 1, wherein the first container further comprises an opening element for displacing portions of the seal from the second opening when the first coupler engages with the second coupler such that the second opening becomes at least partially uncovered to enable the first container to be in flow communication with the second container for mixing the first and second products.

8. The system of claim 7, wherein the opening element comprises a cutting device for at least partially cutting the seal when the first coupler engages with the second coupler.

9. The system of claim 8, wherein the cutting device comprises a trocar.

10. The system of claim 8, wherein the safety member comprises an end surface configured to contact the seal, and wherein the cutting device is formed by a portion of the safety member spaced from the end surface.

11. The system of claim 1, wherein the first coupler comprises a first screw threading, and the second coupler comprises a second screw threading for engaging the first screw threading.

12. The system of claim 1, wherein the safety member extends within the hollow shaft.

13. The system of claim 1, wherein the hollow shaft and the neck form a head.

14. The system of claim 13, wherein the head is formed of a single piece of material.

15. The system of claim 14, wherein the first container further comprises a body, and wherein the head is mounted on the body by one of welding and bonding.

16. The system of claim 1, further comprising a removable stopper for closing the first opening and for protecting the safety member.

17. The system of claim 16, wherein the first container further comprises a neck bearing a screw thread for securing the removable stopper to the first container.

18. The system of claim 1, further comprising a removable stopper configured to be secured to the second container via the second coupler in both a first position and a second position, wherein the seal is capable of being protected in the first position and the seal is capable of being displaced in the second position.

19. The system of claim 18, wherein the removable stopper comprises a wall having skirt including a screw threading for engaging the second coupler, and wherein the removable stopper further comprises the perforating member.

20. The system of claim 1, wherein the first container comprises a tube having elastically deformable walls.

21. The system of claim 20, wherein the tube is formed from polyethylene.

22. The system of claim 1, wherein the second container comprises a tube.

23. The system of claim 22, wherein the tube is formed from aluminum, and the seal comprises an atuminum film.

24. The system of claim 1, further comprising a first product contained in the first container and a second product contained in the second container, wherein the first product and the second product comprise a composition when mixed, the composition being one of a cosmetic product and a care product.

25. The system of claim 24, wherein the composition comprises one of a hair coloring product and a hair care product.

26. The system of claim 24, wherein the first product comprises an oxidizing agent and the second product comprises a dye.

27. The system of claim 1, further comprising a removable stopper comprising the perforating member.

28. A method of mixing at least two products, the method comprising:

providing the system of claim 1, wherein a first product is contained in the first container and a second product is contained in the second container;

engaging the first coupler with the second coupler; and mixing the first product and the second product.

29. The method of claim 28, wherein the mixing of the first product and the second product forms a composition, the composition being one of a cosmetic product and a care product.

30. The method of claim 29, wherein the composition comprises one of a hair coloring and a hair care product.

31. The method of claim 28, wherein the first product comprises an oxidizing agent and the second product comprises a dye.

32. The method of claim 28, further comprising displacing the seal prior to engaging the first coupler with the second coupler.

33. The method of claim 28, wherein the system further comprises a removable stopper configured to be secured to the second container via the second coupler, and wherein the displacing of the seal comprises displacing the seal via the removable stopper.

34. A system for mixing at least two products, the system comprising:

a first container for containing at least a first product, the first container comprising a first opening.

a first coupler, and a blunt safety member;

a second container for containing at least a second product, the second container comprising a second opening, a seal closing the second opening, and a second coupler configured to engage with the first coupler;

a removable stopper for closing the first opening and for protecting the blunt safety member; and a perforating member configured to pierce the seal closing the second opening.

wherein the safety member is configured to press against the seal while the seal maintains closure of the second opening, wherein the first opening is not completely obstructed by the safety member, wherein the safety member extends through the first opening, and wherein the removable stopper comprises a frangible end such that the removable stopper may be used as an applicator tip.

35. A system for mixing at least two products, the system comprising:

a first container for containing a first product, the first container comprising a first opening, a first coupler, a neck, a hollow shaft located within the neck, and a safety member;

a second container for containing a second product, the second container comprising a second opening, a displaceable seal closing the second opening, and a second coupler configured to engage with the first coupler; and a perforating member configured to pierce the displaceable seal closing the second opening, wherein the safety member is configured to prevent engagement between the first coupler and the second coupler prior to displacement of the seal when the safety member is pressed against the seal, wherein the first opening is not completely obstructed by the safety member wherein the hollow shaft defines the first opening and the first coupler is located on the hollow shaft, and wherein the hollow shaft is connected to the neck via a connecting element, and the connecting element comprises at least one vent orifice for allowing air to escape during mixing of the first and second products.

36. The system of claim 35, wherein the seal comprises a film seal.

37. The system of claim 35, wherein the safety member is configured to press against the seal while the first and the second couplers are out of engagement with one another.

38. The system of claim 35, wherein the safety member comprises a protrusion extending at least partially beyond the first opening.

39. The system of claim 38, wherein the protrusion comprises a blunt end for pressing against the seal.

40. The system of claim 39, wherein the blunt end comprises a flat surface.

41. The system of claim 35, wherein the first container further comprises an opening element for displacing portions of the seal from the second opening when the first coupler engages with the second coupler such that the second opening becomes at least partially uncovered to enable the first container to be in flow communication with the second container for mixing the first and second products.

42. The system of claim 41, wherein the opening element comprises a cutting device for at least partially cutting the seal when the first coupler engages with the second coupler.

43. The system of claim 42, wherein the cutting device comprises a trocar.

44. The system of claim 42, wherein the safety member comprises an end surface configured to contact the seal, and wherein the cutting device is formed by a portion of the safety member spaced from the end surface.

45. The system of claim 35, wherein the first coupler comprises a first screw threading, and the second coupler comprises a second screw threading for engaging the first screw threading.

46. The system of claim 35, wherein the safety member extends within the hollow shaft.

47. The system of claim 35, further comprising a removable stopper for closing the first opening and for protecting the safety member.

48. The system of claim 47, wherein the first container further comprises a neck bearing a screw thread for securing the removable stopper to the first container.

49. The system of claim 35, further comprising a removable stopper configured to be secured to the second container via the second coupler in both a first position and a second position, wherein the seal is capable of being protected in the first position and the seal is capable of being displaced in the second position.

50. The system of claim 49, wherein the removable stopper comprises a wall having skirt including a screw threading for engaging the second coupler, and wherein the removable stopper further comprises the perforating member.

51. The system of claim 35, further comprising a first product contained in the first container and a second product contained in the second container, wherein the first product and the second product comprise a composition when mixed, the composition being one of a cosmetic product and a care product.

52. The system of claim 51, wherein the composition comprises one of a hair coloring product and a hair care product.

53. The system of claim 51, wherein the first product comprises an oxidizing agent and the second product comprises a dye.

54. The system of claim 35 further comprising a removable stopper comprising the perforating member.

55. A method of mixing at least two products, the method comprising:

providing the system of claim 35, wherein a first product is contained in the first container and a second product is contained in the second container;

engaging the first coupler with the second coupler; and mixing the first product and the second product.

56. The method of claim 55, wherein the mixing of the first product and the second product forms a composition, the composition being one of a cosmetic product and a care product.

57. The method of claim 56, wherein the composition comprises one of a hair coloring and a hair care product.

58. The method of claim 55, wherein the first product comprises an oxidizing agent and the second product comprises a dye.

59. The method of claim 55, further comprising displacing the seal prior to engaging the first coupler with the second coupler.

60. The method of claim 55, wherein the system further comprises a removable stopper for being secured to the second container via the second coupler, and wherein the displacing of the seal comprises displacing the seal via the removable stopper.

61. A system, for mixing at least two products, the system comprising:

a first container for containing a first product, the first container comprising a first opening, a first coupler, and a safety member:

a second container for containing a second product, the second container comprising a second opening.

a displaceable seal closing the second opening, and a second coupler configured to engage with the first coupler;

a removable stopper for closing the first opening and for protecting the safety member; and a perforating member configured to pierce the displaceable seal closing the second opening, wherein the safety member is configured to prevent engagement between the first coupler and the second coupler prior to displacement of the seal when the safety member is pressed against the seal, wherein the first opening is not completely obstructed by the safety member, and wherein the removable stopper comprises a frangible end such that the removable stopper may be used as an applicator tip.

* * * * *

UNITED STATES PATENT AND TRADEMARK OFFICE

CERTIFICATE OF CORRECTION

PATENT NO. : 7,156,227 B2
APPLICATION NO. : 10/035204
DATED : January 2, 2007
INVENTOR(S) : Vincent De Laforcade It is certified that error appears in the above-identified patent and that said Letters Patent is hereby corrected as shown below:

Claim 23, column 9, line 2, “atuminum” should read --aluminum--.

Claim 54, column 11, line 27, “35 further” should read --35, further--.

Claim 61, column 12, line 12, “system, for” should read --system for--.

Signed and Sealed this

Third Day of April, 2007

JON W. DUDAS
*Director of the United States Patent and Trademark Office*